US007040131B2

(12) United States Patent
Monot

(10) Patent No.: US 7,040,131 B2
(45) Date of Patent: May 9, 2006

(54) COLD FORMING TOOL, MACHINE AND METHOD

(75) Inventor: Philippe Monot, Bragny sur Saône (FR)

(73) Assignee: Escofier Technologies (SAS), Chalone-sur-Saône (FR)

( * ) Notice: Subject to any disclaimer, the term of this patent is extended or adjusted under 35 U.S.C. 154(b) by 87 days.

(21) Appl. No.: 10/485,251

(22) PCT Filed: Aug. 7, 2002

(86) PCT No.: PCT/FR02/02821

§ 371 (c)(1),
(2), (4) Date: Feb. 5, 2004

(87) PCT Pub. No.: WO03/013758

PCT Pub. Date: Feb. 20, 2003

(65) Prior Publication Data

US 2004/0173000 A1 Sep. 9, 2004

(30) Foreign Application Priority Data

Aug. 7, 2001 (FR) ..... 01 10551

(51) Int. Cl.
*B21B 27/00* (2006.01)

(52) U.S. Cl. ..... 72/102; 72/108; 72/703

(58) Field of Classification Search ..... 72/88, 72/90, 102, 103, 104, 108, 469, 703; 470/10, 470/66, 70, 71, 84, 185; 29/893.32
See application file for complete search history.

(56) References Cited

U.S. PATENT DOCUMENTS

| | | | | |
|---|---|---|---|---|
| 2,886,990 A | | 5/1959 | Bregi et al. | |
| 2,937,547 A | * | 5/1960 | Moeltzner | 72/95 |
| 3,201,964 A | * | 8/1965 | Walters | 72/108 |
| 3,626,733 A | * | 12/1971 | Zook et al. | 72/104 |
| 3,651,678 A | * | 3/1972 | Zook et al. | 72/103 |
| 3,979,859 A | | 9/1976 | Miller | |
| 4,362,045 A | * | 12/1982 | Mickas | 72/469 |
| 4,610,154 A | * | 9/1986 | Carene, Jr. | 72/88 |
| 4,862,718 A | * | 9/1989 | LaCroix | 72/88 |
| 5,659,955 A | | 8/1997 | Plamper | |
| 6,324,887 B1 | * | 12/2001 | Sharp | 72/469 |
| 6,779,270 B1 | * | 8/2004 | Sonti et al. | 29/893.32 |

FOREIGN PATENT DOCUMENTS

| | | |
|---|---|---|
| CN | 376875 | 9/2004 |
| DE | 2424033 | 9/2004 |
| WO | 94/20238 | 9/1994 |

* cited by examiner

OTHER PUBLICATIONS

Enlish Languge Abstract of JP62144835.

*Primary Examiner*—Ed Tolan
(74) *Attorney, Agent, or Firm*—Greenblum & Bernstein, P.L.C.

(57) ABSTRACT

Cold forming tool including at least one penetration zone having teeth and a calibration zone having teeth. The teeth having a tooth height that increases substantially from the at least one penetration zone to the calibration zone. A distance between an outer surface and a forming reference axis decreasing from the at least one penetration zone to the calibration zone. A rate of increase in the tooth height between the at least one penetration zone and the calibration zone being greater than a rate of decrease in the distance between the outer surface and the forming reference axis between the at least one penetration zone and the calibration zone. This Abstract is not intended to define the invention disclosed in the specification, nor intended to limit the scope of the invention in any way.

56 Claims, 5 Drawing Sheets

COLD FORMING TOOL, MACHINE AND METHOD

CROSS-REFERENCE TO RELATED APPLICATIONS

The present application is a National Stage Application of International Application No. PCT/FR02/02821, filed Aug. 7, 2002, which published as WO 03/013758 on Feb. 20, 2003. Further, the present application claims priority under 35 U.S.C. § 119 of French Patent Application No. 01/10551 filed on Aug. 7, 2001.

BACKGROUND OF THE INVENTION

1. Field of the Invention

The invention relates to tools for cold forming parts from metallic blanks by revolution, in particular for forming grooves or a knurling.

2. Discussion of Background Information

"Cold forming" means a deformation of the metal of the blank at ambient or semi-hot temperature (up to a temperature of 300–500° C. depending on the metal of the blank), below its melting point.

To form the part from a blank, one generally proceeds according to a so-called "penetration step" during which the blank is engaged with at least one (generally two) forming tool. This penetration step is followed by a second so-called "calibration step" during which the blank is finally calibrated to the desired dimensions for the formed part. During these two steps; the blank is displaced in a relative rotation with respect to the tool, while maintaining the blank under pressure against the tool.

The useful surface of the tool has a plurality of trapezoidal or prismatic teeth having straight or curvilinear sides, and capable of forming grooves or other desired part profile. The teeth of the tool are regularly spaced over a surface of the tool called the "tooth gullet." They can have different heights in relation to the tooth gullet. The tooth gullet itself can have a variable height in relation to a forming reference axis or plane on the tool, which usually defines the positioning and/or displacement of the tool in relation to the blank to be formed.

These variations in height define the overall profile of the tool, which generally has a first zone, so-called "penetration zone," for the first step, followed by a second zone, so-called "calibration zone," for the second step. In known tools, the penetration zone has teeth, the height of which increases with respect to the forming reference axis. During the displacement of the blank in relation to the tool, a slip may occur due to a loss of contact between the surface of the blank to be formed and the tips of the first teeth of the tool. Furthermore, the Applicant has noted a frequent wear on the first teeth.

SUMMARY OF THE INVENTION

The present invention improves the situation.

The invention in particular relates to a cold forming tool, adapted to form a part by revolution, with substantially no axial displacement; i.e., a blank is rotated and formed by the tool without this being accompanied by a helical movement of the blank, which would comprise a significant axial component. The forming tool has regularly-spaced teeth on a tooth gullet defining, with respect to a forming reference axis which the tool comprises, at least one penetration zone followed by a calibration zone.

According to a first characteristic, the teeth of the tool have a height that increases substantially from the penetration zone to the calibration zone, whereas the tooth gullet is located at a decreasing distance from the forming reference axis.

According to a second characteristic, the increase in the tooth height is more rapid than the decrease in the distance from the tooth gullet to the forming reference axis. Thus, the tips of the teeth are separated from the forming reference axis by a substantially increasing distance, and this from the penetration zone to the beginning of the calibration zone.

According to a third characteristic, the tool comprises a plate that is wider than the teeth at the beginning of the penetration zone. By "plate" is meant a surface that demarcates the beginning of the penetration zone, and which may be planar, particularly for a tool of the rack type, or incurved, particularly for a tool of the knurl type.

Preferably, the tooth gullet has this plate, and the first teeth of the penetration zone follow the plate.

Preferably, the distance between the plate and the forming reference axis is substantially equal to a mean distance from the teeth, at mid-height, in relation to the forming reference axis.

According to an advantageous optional characteristic, the teeth, at mid-height, and the forming reference axis are separated by a substantially constant distance, at least in the penetration zone.

According to another advantageous optional characteristic, the tooth gullet is at a maximum distance from the forming reference axis at the beginning of the penetration zone.

According to yet another advantageous optional characteristic, the distance from the tooth gullet to the forming axis varies in a substantially continuous manner, at least from the beginning of the penetration zone (A) up to the beginning of the calibration zone (B).

According to another advantageous optional characteristic, the height of the teeth varies in a substantially continuous manner, at least in the penetration zone.

According to another advantageous optional characteristic, the tool further comprises a starting zone that precedes the penetration zone and comprises a bottom line at an increasing distance with respect to the forming reference axis.

Preferably, the starting zone is formed substantially by a lead chamfer, and it immediately precedes the penetration zone, so that the bottom line and forming reference axis, at the end of the starting zone, on the one hand, and the tooth gullet and the forming reference axis, at the beginning of the penetration zone, on the other hand, are separated by substantially equal respective distances.

According to another advantageous optional characteristic, the tooth height is substantially constant in the calibration zone.

According to another advantageous optional characteristic, the distance from the tooth gullet to the forming reference axis is substantially constant in the calibration zone.

According to another advantageous optional characteristic, the teeth, at least in said penetration zone, have a substantially trapezoidal shape with straight or curvilinear sides.

According to another advantageous optional characteristic, the calibration zone is followed by a decompression zone in which, since the teeth, in principle, have a constant profile, the distance between a given point of the profile of each tooth and the forming reference axis is substantially decreasing, which can be more simply expressed in this case as follows: the distance between the teeth and the forming reference axis is substantially decreasing.

According to another advantageous optional characteristic, the tool comprises a substantially planar useful surface, of the rack type, whereas the forming reference substantially has the same direction as the larger side of the rack. The forming reference on a tool having a useful surface of the rack type can also be defined by a support plane of the rack.

In a variation, the tool comprises a substantially cylindrical useful surface, of the knurl type, whereas the forming reference axis coincides substantially with the axis of rotation of the knurl.

The present invention also aims at a cold forming machine that comprises at least one tool according to the invention.

Preferably, the machine comprises two tools, as well as an arrangement for displacing the tools in relation to one another, while maintaining the useful surfaces of the tools opposite one another.

In an embodiment where the tools comprise a substantially planar useful surface, of the rack type, the machine advantageously comprises an arrangement for the relative displacement of the tools, in translation and in opposite directions, along their respective reference axes.

In another embodiment where the tools comprise a substantially cylindrical useful surface, of the knurl type, the machine advantageously comprises an arrangement for the relative displacement of the tools, in rotation and in the same direction.

According to an advantageous optional characteristic, the arrangement for the relative displacement of the tools are arranged to be activated in concordance, such that the penetration and calibration zones of one tool coincide with the penetration and calibration zones, respectively, of the other tool.

Advantageously, the machine further comprises a secondary arrangement for distancing the tools from one another. The secondary arrangement is arranged to be activated at least after the calibration of the blank.

As a complement, or as a variation, the tool has a decompression zone in which the distance from the teeth in relation to the forming reference axis is substantially decreasing.

The present invention also provides for a method for cold forming a part blank, comprising the following process stages:

a) providing at least one forming tool equipped with a penetration zone followed by a calibration zone,
b) arranging the blank to be formed under pressure against the tool, and
c) displacing the blank relatively with respect to the tool, such that the blank is engaged with the penetration zone of the tool, up to the calibration zone, to form the blank.

According to a first characteristic of the method, stage a) provides a tool according to the invention and, during stage c), the blank is first engaged with the beginning of the penetration zone of the tool.

According to a second characteristic of the method, the tooth gullet of the tool comprises a plate that is wider than the teeth at the beginning of the penetration zone, and, in stage c), the blank is first engaged with this plate.

Advantageously, the tool further comprises a starting zone that precedes the penetration zone and comprises a bottom line at an increasing distance in relation to the forming reference axis, and, in stage b), the blank is positioned opposite the starting zone of the tool.

Preferably, during stage a), a second homologous tool is provided, and, during stage c), the blank is engaged against the beginning of the respective penetration zones of the tools.

The invention also provides for a cold forming tool having a forming reference axis and a plurality of regularly-spaced teeth with tips wherein the plurality of regularly-spaced teeth project away from an outer surface. The cold forming tool comprises at least one penetration zone defined by the forming reference axis and comprising some of the plurality of regularly-spaced teeth. A calibration zone following the at least one penetration zone. The calibration zone is defined by the forming reference axis and comprises some of the plurality of regularly-spaced teeth. The plurality of regularly-spaced teeth have a tooth height that increases substantially from the at least one penetration zone to the calibration zone. A distance between the outer surface and the forming reference axis decreases from the at least one penetration zone to the calibration zone. A rate of increase in the tooth height between the at least one penetration zone and the calibration zone is greater than a rate of decrease in the distance between the outer surface and the forming reference axis between the at least one penetration zone and the calibration zone, whereby a distance between the tips and the forming reference axis increases substantially from a beginning of the at least one penetration zone to a beginning of the calibration zone, wherein the cold forming tool is adapted to form a part by rotating the part and ensuring that the part has substantially no axial displacement.

The may further comprise a plate region having a width that is greater than a width of the plurality of regularly spaced teeth located at the beginning of the at least one penetration zone. A distance between the outer surface and the forming reference axis may be the same as a distance between an outer surface of the plate region and the forming reference axis. The plate region may be arranged adjacent a beginning of the at least one penetration zone. The at least one penetration zone may be arranged between the plate region and the calibration zone. A mean distance between a mid-height of the plurality of teeth and the forming reference axis may be substantially equal to a distance between an outer surface of the plate region and the forming reference axis.

At least in the at least one penetration zone, a distance between a mid-height of each of the plurality of teeth and the forming reference axis may be substantially constant. The distance between the outer surface and the forming reference axis at a beginning of the at least one penetration zone may comprise a maximum distance between the outer surface and the forming reference axis. The distance between the outer surface and the forming reference axis may be greater at a beginning of the at least one penetration zone than in another portions of the at least one penetration zone and than in the calibration zone. The distance between the outer surface and the forming reference axis may vary in a substantially continuous manner at least between a beginning of the at least one penetration zone and a beginning of the calibration zone. The distance between the outer surface and the forming reference axis changes substantially continuously at least between a beginning of the at least one penetration zone and a beginning of the calibration zone.

The distance between the tips and the forming reference axis may change substantially continuously from a beginning of the at least one penetration zone to a beginning of the calibration zone. The tooth height may change substantially continuously from a beginning of the at least one penetration zone to a beginning of the calibration zone.

The tool may further comprise a starting zone defined by the forming reference axis. The at least one penetration zone may be arranged between the starting zone and the calibration zone. The starting zone may comprise an outer surface having an increasing distance with respect to the forming reference axis. The starting zone may comprise an outer surface whose distance from the forming reference axis increases between a beginning of the starting zone and an end of the starting zone arranged adjacent a beginning of the at least one penetrating zone. At the end of the starting zone, the distance between the outer surface of the starting zone and the forming reference axis may be substantially equal to the distance between the outer surface and the forming reference axis in the beginning of the at least one penetrating zone. The tooth height in the calibration zone may be substantially constant. The distance between the outer surface and the forming reference axis in the calibration zone may be substantially constant. Each of the plurality of regularly-spaced teeth may have a substantially trapezoidal shape in the at least one penetrating zone. The trapezoidal shape may comprise one or straight sides and curvilinear sides.

The tool may further comprise a decompression zone defined by the forming reference axis and comprising some of the plurality of regularly-spaced teeth. The calibration zone may be arranged between the at least one penetrating zone and the decompression zone. A distance between the tips and the forming reference axis may decrease substantially from a beginning to an end of the decompression zone.

The cold forming tool may comprise a substantially cylindrical part engaging surface. The substantially cylindrical part engaging surface may comprise a knurl surface. The forming reference axis may substantially coincide with an axis of rotation of the knurl surface.

The invention also provides for a cold forming machine comprising at least one cold forming tool as described above.

The invention also provides for a cold forming machine comprising two cold forming tools as described above wherein axes of the two cold forming tools are arranged parallel to one another.

The invention also provides for a cold forming tool having a substantially planar part engaging surface and a plurality of regularly-spaced teeth with tips wherein the plurality of regularly-spaced teeth project away from an outer surface. The cold forming tool comprises at least one penetration zone comprising some of the plurality of regularly-spaced teeth. A calibration zone is arranged adjacent the at least one penetration zone. The calibration zone comprises some of the plurality of regularly-spaced teeth. The plurality of regularly-spaced teeth have a tooth height that increases substantially from the at least one penetration zone to the calibration zone. A distance between the outer surface and a reference plane decreases from the at least one penetration zone to the calibration zone. A rate of increase in the tooth height between the at least one penetration zone and the calibration zone is greater than a rate of decrease in the distance between the outer surface and the reference plane between the at least one penetration zone and the calibration zone, whereby a distance between the tips and the reference plane increases substantially from a beginning of the at least one penetration zone to a beginning of the calibration zone. The cold forming tool is adapted to form a part by rotating the part and ensuring that the part has substantially no axial displacement.

The cold forming tool may comprises a cold forming rack.

The invention also provides for a cold forming machine comprising at least one cold forming tool as described above.

The invention also provides for a cold forming machine comprising two cold forming tools as described above wherein the substantially planar part engaging surfaces of the two cold forming tools are arranged parallel to one another.

The invention also provides for a cold forming machine comprising a first cold forming tool having a first part engaging surface and a plurality of regularly-spaced teeth with tips wherein the plurality of regularly-spaced teeth project away from a first surface. The first cold forming tool comprises at least one penetration zone comprising some of the plurality of regularly-spaced teeth, a calibration zone arranged adjacent the at least one penetration zone, the calibration zone comprising some of the plurality of regularly-spaced teeth, the plurality of regularly-spaced teeth having a tooth height that increases substantially from the at least one penetration zone to the calibration zone, a distance between the first surface and a first reference location decreasing from the at least one penetration zone to the calibration zone, and a rate of increase in the tooth height between the at least one penetration zone and the calibration zone being greater than a rate of decrease in the distance between the first surface and the first reference location between the at least one penetration zone and the calibration zone, whereby a distance between the tips and the first reference location increases substantially from a beginning of the at least one penetration zone to a beginning of the calibration zone. A second cold forming tool comprises a second part engaging surface and a plurality of regularly-spaced teeth with tips wherein the plurality of regularly-spaced teeth project away from a second surface. The second cold forming tool comprises at least one penetration zone comprising some of the plurality of regularly-spaced teeth, a calibration zone arranged adjacent the at least one penetration zone, the calibration zone comprising some of the plurality of regularly-spaced teeth, the plurality of regularly-spaced teeth having a tooth height that increases substantially from the at least one penetration zone to the calibration zone, a distance between the second surface and a second reference location decreasing from the at least one penetration zone to the calibration zone, and a rate of increase in the tooth height between the at least one penetration zone and the calibration zone being greater than a rate of decrease in the distance between the second surface and the second reference location between the at least one penetration zone and the calibration zone, whereby a distance between the tips and the second reference location increases substantially from a beginning of the at least one penetration zone to a beginning of the calibration zone. An arrangement for moving the first and second cold forming tools. The cold forming machine is adapted to form a part by rotating the part and ensuring that the part has substantially no axial displacement.

The first and second part engaging surfaces may be arranged opposite one another. The first reference location may comprise a first rotation axis of the first cold forming tool and the second reference location comprises a second rotation axis of the second cold forming tool. The first reference location may comprise a first reference plane and the second reference location comprises a second reference plane. The first and second part engaging surfaces may comprise substantially cylindrical part engaging surfaces.

The first and second part engaging surfaces may comprise substantially planar part engaging surfaces.

The arrangement for moving the first and second cold forming tools may move the first and second tools relative to one another and in opposite directions. The arrangement for moving the first and second cold forming tools may move the first and second tools parallel to one another and in opposite directions. The arrangement for moving the first and second cold forming tools may cause the first and second tools to rotate. The arrangement for moving the first and second cold forming tools may rotate the first and second tools in opposite directions. The arrangement for moving the first and second cold forming tools may move, at the same time, the first and second tools into engagement with the part.

The machine may further comprise an arrangement for moving the first and second cold forming tools away from one another, whereby the arrangement for moving the first and second cold forming tools away from one another is adapted to be activated at least after a blank calibration stage is performed.

Each of the first and second cold forming tools may comprise a decompression zone. A distance between the tips and the first reference location may decrease substantially from a beginning to an end of the decompression zone of the first cold forming tool, and a distance between the tips and the second reference location may decrease substantially from a beginning to an end of the decompression zone of the second cold forming tool.

The invention also provides for a method for cold forming a blank, wherein the method comprises positioning at least one forming tool adjacent to the blank, the at least one forming tool comprising a penetration zone followed by a calibration zone and engaging the blank first with a beginning of the penetration zone and then with the calibration zone, wherein the blank moves during the engaging.

The at least one forming tool may further comprise an outer surface an a plurality of teeth projecting away from an outer surface. The at least one forming tool may further comprise a plate region having a width that is greater than a width of the plurality of teeth arranged in the beginning of the penetration zone. The engaging may comprise engaging the blank first with the plate region, then with the beginning of the penetration zone, and then with the calibration zone.

The at least one forming tool may further comprise a starting zone that precedes the penetration zone. The starting zone may comprise an outer surface whose distance from a forming reference axis increases between a beginning of the starting zone and an end of the starting zone arranged adjacent a beginning of the penetrating zone, and the engaging may comprise engaging the blank first with the starting zone, then with the penetration zone, and then with the calibration zone.

The positioning may comprise positioning two forming tools adjacent to the blank, each of the two forming tools comprising a penetration zone followed by a calibration zone and the engaging may comprise engaging the blank with the two tools first with a beginning of the penetration zones and then with the calibration zones. The two tools may be homologous.

The invention also provides for a cold forming tool having a plurality of teeth with tips wherein the plurality of teeth project away from an outer surface, wherein the cold forming tool comprises a penetration zone comprising some of the plurality of teeth. A calibration zone is arranged adjacent the penetration zone and comprising some of the plurality of teeth. Each adjacent tooth of the penetrating zone increases in height from a beginning of the penetration zone to a beginning of the calibration zone. A distance between the outer surface and a reference point decreases from a beginning of the penetration zone to at least a beginning of the calibration zone. A rate of increase in the tooth height between the penetration zone and the calibration zone is greater than a rate of decrease in the distance between the outer surface and the reference point between the penetration zone and the calibration zone, whereby a distance between the tips and the reference point substantially increases from a beginning of the at least one penetration zone to a beginning of the calibration zone. The cold forming tool is adapted to form a part by rotating the part and ensuring that the part has substantially no axial displacement.

Other characteristics and advantages of the invention will become apparent from the following detailed description and annexed drawings.

DETAILED DESCRIPTION OF THE INVENTION

The following detailed description and drawings essentially contain elements with unquestionable characteristics. Therefore, they will not only help to better understand the description, but they will also contribute to the definition of the invention, if necessary.

Although the invention is not limited to the embodiments hereinafter, tools enabling cold or semi-hot forming of grooves on revolving parts, as well as machines having such tools, are described here.

Figure 1:
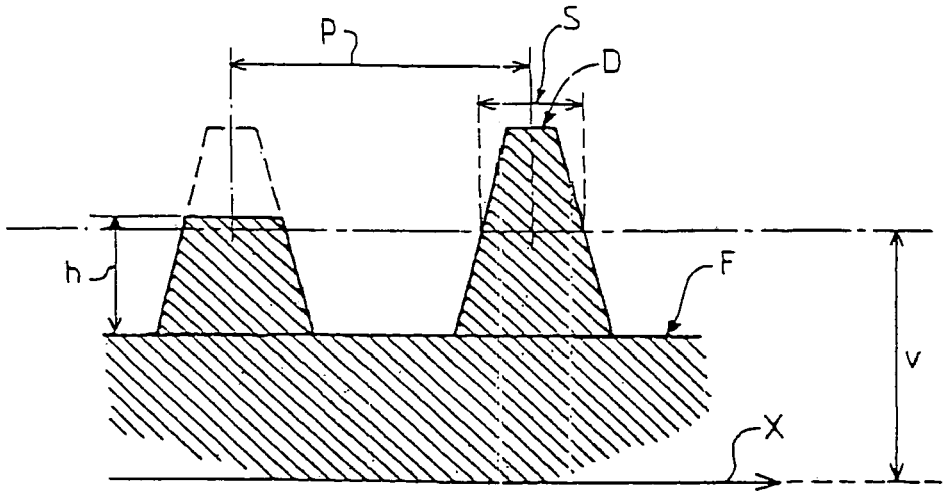
FIG. 1 schematically shows teeth for cold forming blanks of metallic parts by revolution.

Reference is initially made to FIG. 1, in which a forming tool has teeth D of variable height h that are regularly-spaced by a pitch p on a tooth gullet F. The tooth gullet F extends over a substantially planer surface, for a tool of the rack type, or over a substantially incurved, convex surface, for a rotatable tool of the knurl type. The variation in the profile of the tooth gullet F is defined here with respect to the distance that separates it from a forming reference axis X.

In the case of a tool of the knurl type, the forming reference axis X corresponds to the axis of rotation of the knurl.

In the example shown, the tool is of the rack type. While the reference axis X, for a knurl, is its axis of rotation, the latter, for a rack in translation, is thrown into an infinite plane. For convenience, a plane substantially parallel to the larger side of the rack or yet to its direction of displacement is considered in this case as a forming reference. In a variation, to take mechanical effects into account, the profile of the tooth gullet F can also be defined with respect to the distance that separates it from a forming reference plane, this reference plane corresponding to a support plane of the rack (perpendicular to the plane of FIG. 1 and including the axis X that is represented therein).

In the example shown, the teeth have a substantially trapezoidal shape. In a variation, they can be substantially prismatic, with a triangular base. In particular, the teeth have a variable height h, but they remain substantially circumscribed in a trapezoid (shown in dotted line), such that the pitch p between the teeth remains substantially constant and the angles of the flanks of the teeth remain substantially constant with respect to the tooth gullet F.

In FIG. 1, a "measurement" line is considered, which passes substantially at the mid-height of the calibration teeth. This line is extended in the penetration zone (at least), by remaining at a substantially constant distance "v" from the reference axis or plane. The "tooth thickness" referred to here is the dimension "s" of each tooth along this line.

Most often, this tooth thickness "s" is substantially constant in the penetration and calibration zones.

Figure 2:
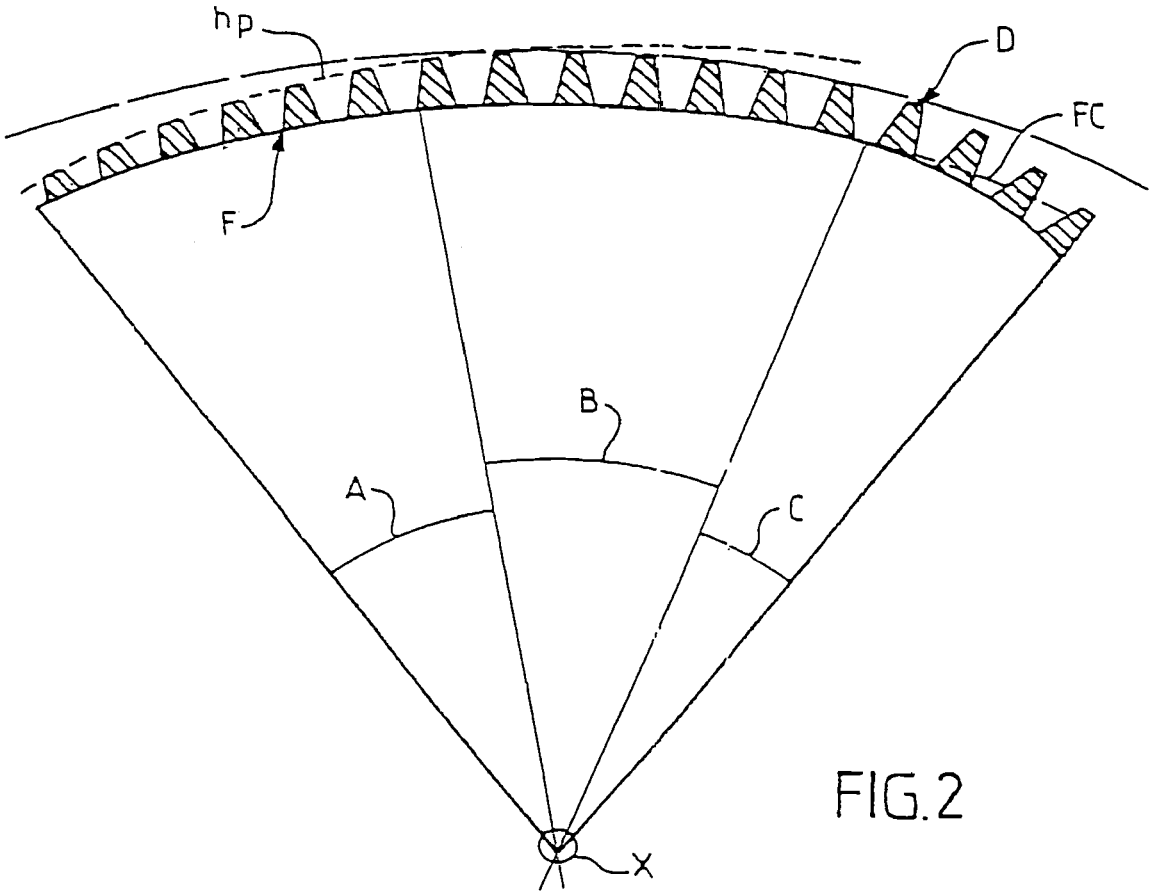
FIG.2 PRIOR ART
FIG. 2 schematically shows a prior art cold forming tool (in the form of a toothed sector in the example shown)

Reference is now made to FIG. 2 to describe a tool of the knurl type from the prior art (shown in the form of a toothed sector by way of example). The tool has a first zone A, so called "penetration zone," followed by a second zone B, called "calibration zone," as well as a following third zone C, so-called "decompression zone." In the calibration zone B, the teeth D have a substantially constant height and are regularly spaced on the tooth gullet F whose profile is defined by a substantially constant distance with respect to the reference axis X (corresponding to the axis of rotation of the toothed sector). However, in the penetration zone A, the teeth D have an increasing height hp. Generally speaking, the first tooth of the knurl has a height corresponding substantially to 50% of the height of the teeth D in the calibration zone B. In addition, in the decompression zone C, the height of the teeth D remains substantially the same as the height of the teeth in the calibration zone B. However, the distance that separates the tooth gullet F from the forming reference axis X decreases with respect to that of the calibration zone B (dotted line FC). Thus, the metal of the part that is finally formed expands progressively, with a decreasing pressure of the teeth D in the decompression zone C.

In the penetration zone, the profile of the tool therefore develops radially to penetrate progressively into the part. The forming itself ends in the calibration zone. In the decompression zone, the part finally formed comprises a profile corresponding to that of the tool.

The profile of the tool of the type shown in FIG. 2, for forming grooves, particularly has the advantages of quickness, precision with respect to the surface condition of the part (practically corresponding to the surface condition of the tools themselves), material savings since the outer diameter of the finished part is ultimately greater than the diameter of the starting blank, as well as an increase in the mechanical resistance due to the cold-hammering phenomenon.

In the so-called technique of "part forming by revolution," two or more profiled tools are engaged against a blank to be shaped, between two contact zones that are diametrically opposed or yet circularly arranged. These tools are in contact with the blank, in rotation, without a slip, and exert on the latter a progressive and deforming pressure in order to create on the blank a profile conjugate with that of the tools. In the methods currently used for cold forming on the machines having progressive tools, the machines using cylindrical knurls with a progressive profile, the machines using rectilinear tools (racks) with a progressive profile, are implemented.

The forming of grooves lends itself to numerous applications, particularly in the automobile industry for the mass production of transmission parts, gear boxes, torsion bars, and more.

However, in this type of prior art tool, a slip is possible when the blank is rotated, this slip being due to the loss of contact between the first teeth of the tool and the blank, which, as a result, causes a quality defect in the tooth division.

Figure 3:
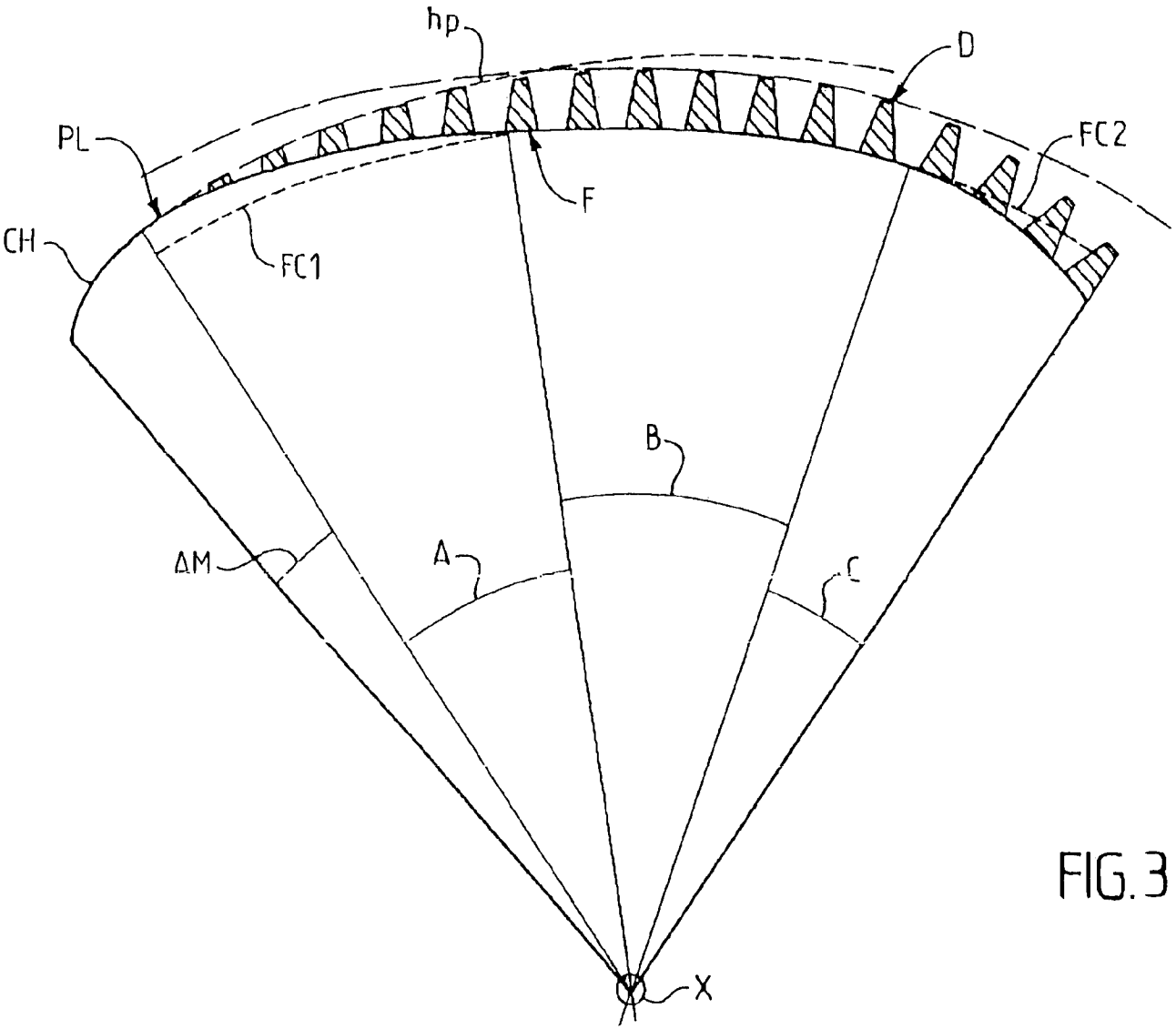
FIG. 3 schematically shows a tool according to the invention (in the form of a toothed sector in the example shown)

Reference is now made to FIG. 3 to describe, in principle, a tool (of the knurl type in the example shown) according to the invention. The height of the teeth D remains substantially constant in the calibration zone B, and the same is true for the distance that separates the tooth gullet F from the forming reference axis X in the calibration zone B. The height of the teeth D remains substantially constant in the decompression zone C, but the tooth gullet F is separated from the reference axis X by a decreasing distance, with respect to the profile of the tooth gullet in the calibration zone B (dotted line FC2).

However, the profile of the penetration zone A of the tool according to the invention is different from that of the prior art shown in FIG. 2.

According to the invention, the height of the teeth D substantially increases in the penetration zone A (profile of the tip hp of the teeth shown in dotted line), whereas the tooth gullet F is separated from the forming reference axis X by a decreasing distance (to be compared to the distance separating the tooth gullet from the reference axis X in the calibration zone B shown in dotted line FC1). The increase in the height of the teeth is quicker (more substantial) than the decrease in the distance from the tooth gullet to the forming reference axis. The curve hp passing by the tips of the teeth is therefore separated from the forming reference axis X by an increasing distance, from the beginning of the penetration zone A up to the beginning of the calibration zone B.

The present invention can rely on the definition of the tooth height and of the tooth gullet level taken with respect to the reference axis or plane, or an element related to them.

Two principles of progressivity are defined:

one for the increase in the tooth height, the other for the decrease in the distance from the tooth gullet to the reference axis.

These laws define a continuous progressivity, adjusted to each example of application, according to a mathematical law providing small variations in progressivity, for example a polynomial law, which can be linear in the simplest case.

At the beginning of the penetration zone A, the tooth height is practically zero, but the tooth gullet F has a plate PL (or a convex incurved surface) that immediately precedes the first teeth. Thus, the tooth gullet F is at a maximum distance from the forming reference axis X at the beginning of the penetration zone A.

At the same time, the characteristic according to which the tooth thickness s is substantially constant in the penetration and calibration zones can be preserved.

In the schematic illustrations of FIGS. 2 and 3, the useful surfaces of the tools extend over limited angular ranges. Naturally, these angular ranges are larger in practice, as will be seen later with reference to FIG. 7. Similarly, the angular ranges over which the various zones A, B, C of the tools extend are, in practice, different from those that are shown.

According to one of the advantages procured by the present invention, the first teeth are more resistant, which makes it possible to ensure pressurizing on a shorter zone and thus to better distribute the load on the penetration teeth that follow. The useful life of the tool can thus be prolonged. Moreover, the reduction in the loss of contact between the first teeth (due to the acceleration of the pressurizing) makes it possible to improve the division quality of the rolled parts. Furthermore, the manufacture of the tools themselves makes it possible to reduce the tool machining time, up to 8% according to the tests conducted by the Applicant, since only the useful portion of the toothing must be machined here.

A tool of the rack type is known from the document WO94/20238 for cold forming gearwheels, and the profile of which begins with an increasing height of the gearwheel teeth and a tooth gullet of decreasing height. However, this beginning of the tool profile corresponds to both a penetration zone and a calibration zone, which are specific to the forming of gearwheels. In particular, to form gearwheels, according to this document, the teeth of the tool are defined to respect specific shapes and dimensions. In this case, the tooth height is selected for penetrating into the blank, as well as for calibrating in particular the tip and gullet of the teeth of the gearwheel to be formed. For the forming of grooves, in the sense of the present invention, only the flanks of the teeth must respect particular shapes and dimensions, and the invention takes advantage of the tooth height in the penetration zone, adapted progressively to the minimum necessary for the displacement of the material of the blank. In the invention, the first teeth of the tool have no particular function of calibrating the tooth gullet and tips.

Thus, the tool of the present invention is profiled such that the tooth gullet, in the penetration zone, does not deform the blank substantially and, therefore, does not contribute to its deformation.

Advantageously, the tool of the invention further has a starting zone AM, the profile of which is defined by a substantially increasing distance with respect to the reference axis X and joins the tooth gullet of the penetration zone A. In the example shown, the profile of the starting zone AM has the form of a lead chamfer CH, which is extended by the plate PL of the penetration zone A.

According to a first advantage procured by the present invention, the tool according to the invention can be used directly on one of the aforementioned machines, without modification of the latter.

Figure 4:
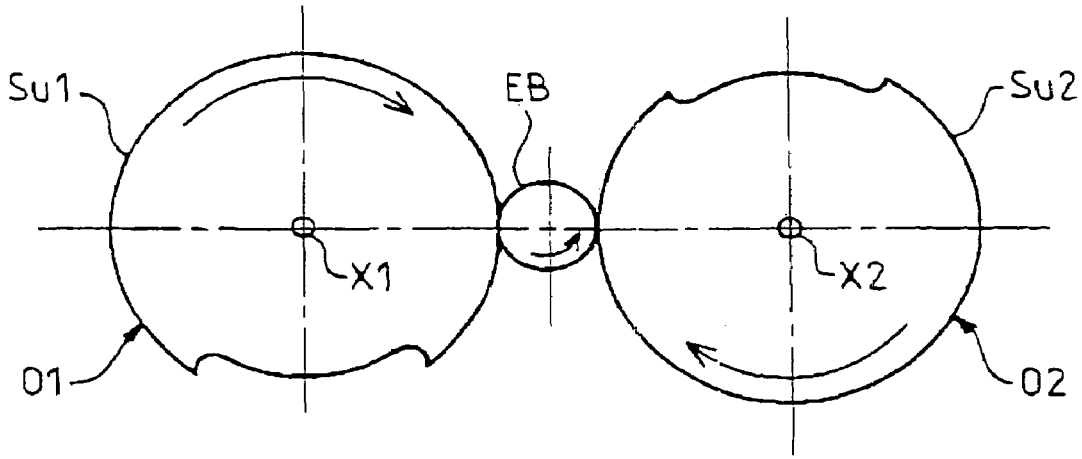
FIG. 4 partially shows a machine equipped with two forming tools of the knurl type.

Reference is now made to FIG. 4 to describe a machine for forming tools of the knurl type by revolution. In the example, the machine has two tools O1 and O2, as well as an arrangement for the rotational displacement of these tools in the same direction and about substantially parallel axes X1 and X2. These axes define the respective forming reference axes of the tools. The blank EB to be formed is kept under pressure between both tools O1 and O2. The machine has a support for the blank EB, such that it is displaced rotationally, in the direction opposite the tools, about an axis that is substantially coplanar with the two axes of rotation X1 and X2. The machine further has an arrangement for distancing the two axes X1 and X2, which can be used prior to or during the process of forming the blank EB, as well as an arrangement for adjusting the concordance of the various zones of the tool (penetration, calibration, decompression).

Figure 5:
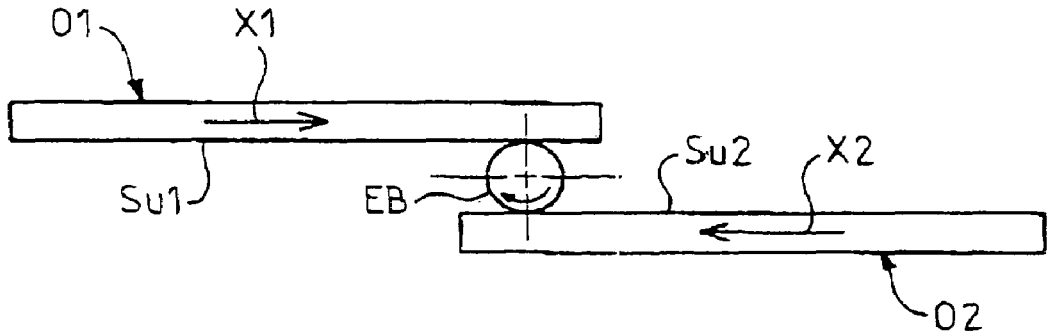
FIG. 5 partially shows a machine equipped with two forming tools of the rack type.

FIG. 5 shows, according to the same principle for rotating the blank EB, a machine of the rack type comprising two tools O1 and O2, as well as an arrangement for translational displacement of these tools along these axes X1 and X2. The axes X1 and X2 are preferably parallel and correspond to the forming reference axes; the distance that separates them from the useful surface Su1 and Su2 of the tools makes it possible to define the profile of the tooth gullet of these tools. As in the embodiment of FIG. 4, the machine here has an arrangement for distancing the two axes X1 and X2. Thus, the respective zones of the tools are opposite one another, as the tools move along their axes X1 and X2 during the forming of the blank EB.

Figure 6:
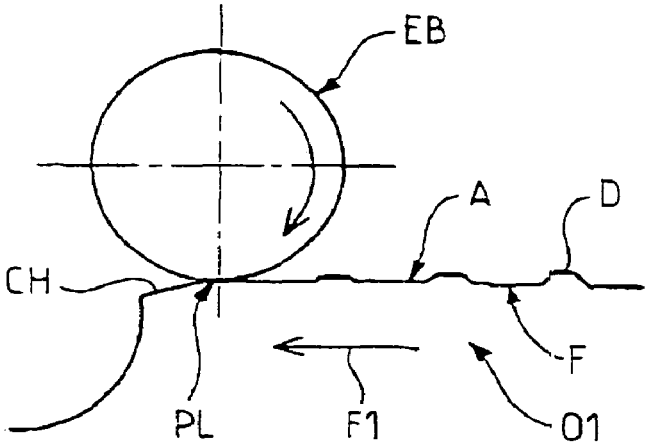
FIG. 6 schematically shows a tool of the rack or knurl type according to the invention, in use.

Reference is now made to FIG. 6 to describe the method for forming with a tool (of the rack or knurl type in the example shown) according to the invention, in order to produce grooves on the surface of the blank EB. The tool O1 is displaced tangentially (arrow F1) in relation to the blank EB, which is in contact, under pressure, against the useful surface of the tool O1. The blank EB then undertakes a rotational movement about its central axis. The surface of the blank EB first meets the lead chamfer CH in the starting zone of the tool O1, then the plate PL formed by the tooth gullet at the beginning of penetration zone A of the tool. Next, the surface of the blank EB meets the first tool teeth D of increasing height, whereas the tooth gullet F is at a decreasing distance from the forming reference axis (which can be defined here by the arrow F1).

In order not to crowd FIG. 6, only one tool O1 is shown but, naturally, two tools are provided in practice on both sides of the blank EB.

Reference is now made to FIGS. 7, 7A, 7B and 7C to describe a knurl-type tool for forming grooves, according to a more detailed representation. In this example, the perimeter of the tool includes substantially four zones:

- a penetration zone (FIG. 7A);
- a calibration zone (FIG. 7B);
- a decompression zone (FIG. 7C); and
- a clearance zone CZ, without teeth, and the bottom line of which is at relatively small distance with respect to the forming reference axis X (which corresponds here to the axis of rotation of the tool).

In the example described, the penetration zone extends over an angular range of approximately 252°. The calibration zone extends over an angular range of 32°. The decompression zone extends over an angular range of 16°.

Figure 7:
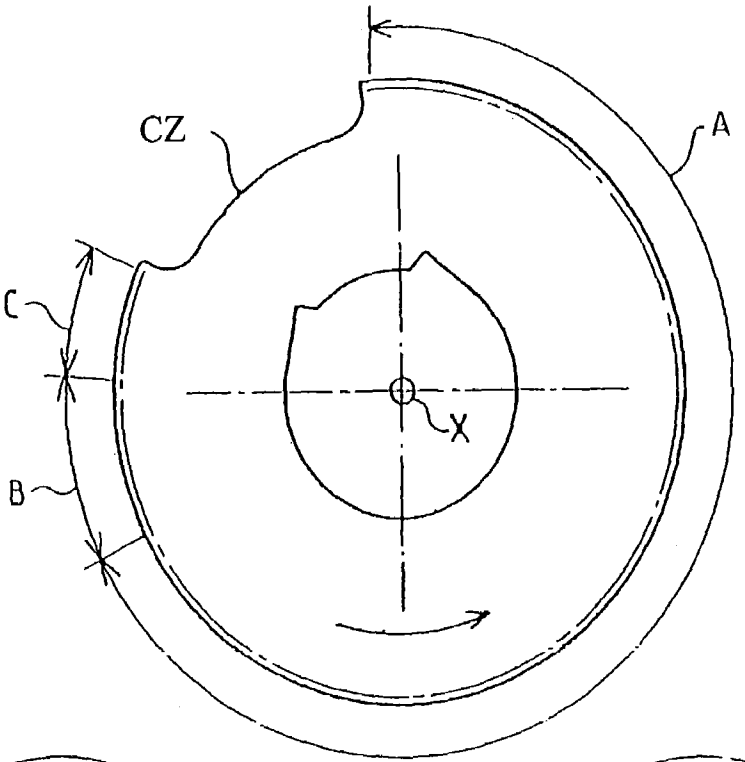
FIG. 7 shows a knurl type forming tool of the invention, according to a more detailed representation.
Figure 7C:
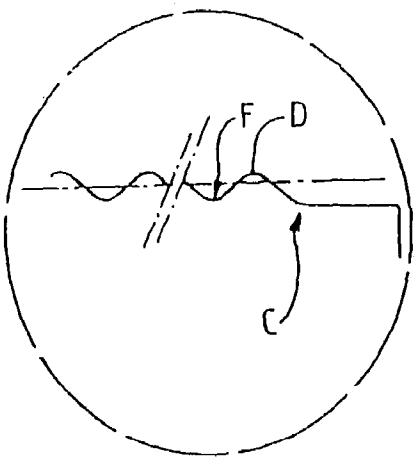
FIG. 7C is a detailed view of the decompression zone of the tool of FIG. 7.
Figure 7B:
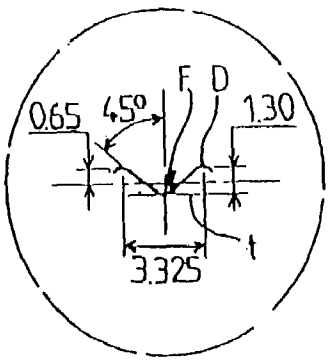
FIG. 7B is a detailed view of the calibration zone of the tool of FIG. 7.
Figure 7A:
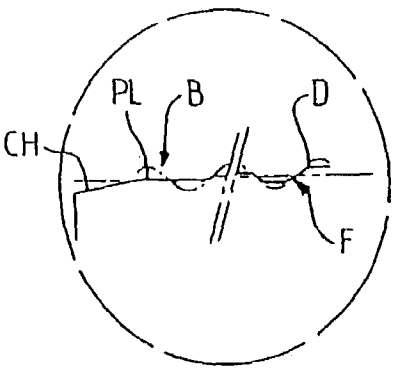
FIG. 7A is a detailed view of the penetration zone of the tool of FIG. 7.

Referring to FIG. 7A, a starting zone having a lead chamfer CH is provided between the clearance zone CZ and the beginning of the penetration zone A, followed by a plate PL that the tooth gullet F has at the beginning of the penetration zone. The variations in the profile of the teeth D of the penetration zone are represented by a thick line, compared to the profile of the teeth D in the calibration zone (represented by a thin line and designated by the arrow B). Therefore, in the penetration zone, the teeth D have an increasing height, whereas the tooth gullet is at a decreasing distance with respect to a forming reference axis (not shown). Moreover, the teeth D have a trapezoidal shape, whereas, in the calibration zone (FIG. 7B), the teeth have a substantially prismatic shape (substantially triangular in a transverse cross-section of the teeth). Similarly, the tooth gullet F in the penetration zone has a substantially trapezoidal hollow shape.

It is noted that the profile of the tool is substantially continuous from the starting zone to the decompression zone. In particular, the distance from the tooth gullet to the forming axis varies in a substantially continuous manner, and the tooth height also varies in a substantially continuous manner, at least in the penetration zone.

In the calibration zone B, the teeth substantially have the same profile and are shown on scale in FIG. 7B. The tooth gullet is defined by the horizontal tangent t (FIG. 7B).

As previously mentioned, the characteristic according to which the tooth thickness s is substantially constant in the penetration and calibration zones can be preserved at the same time.

However, in the decompression zone C, the teeth keep the same height as in the calibration zone, but the tooth gullet F is separated from the reference axis X by a decreasing distance, which advantageously makes it possible to progressively relax the material of the part formed.

Figure 8A:
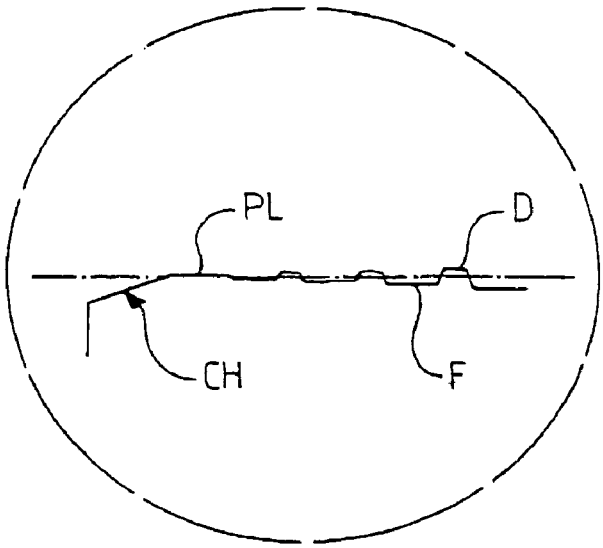
FIGS. 8A and 8B show an alternative embodiment of the teeth of the tool.
Figure 8B:
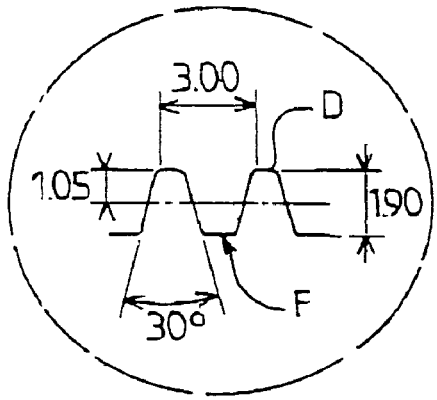

In the variation of FIGS. 8A and 8B, applicable to a rack, the lead chamfer CH in the starting zone of the tool is immediately followed by a plate PL of the penetration zone that the tooth gullet F has at the beginning of this penetration zone (FIG. 8A). The first teeth that follow the plate PL then have an increasing height, whereas the tooth gullet F is at a decreasing distance with respect to a forming reference axis in the tool (not shown here). In particular, the distance from the tooth gullet F to the forming reference axis decreases in proportions similar to the increase in the height of the teeth D in the penetration zone. Thus, the mid-height of the teeth in the penetration zone and up to the calibration zone (FIG. 8B) is at a substantially constant distance from the forming reference axis. In particular, the plate PL is separated from the forming reference axis by this same distance. Advantageously, the chamfer CH of the starting zone and the plate PL define a continuous profile at the beginning of the penetration zone, without sudden variation in the height of the profile. FIG. 8B shows, on scale, the profile of the teeth D in the calibration zone. Referring to FIG. 7, a substantial decrease in the distance that separates the teeth from the forming reference axis is noticeable in the decompression zone C.

Naturally, the present invention is not limited to the embodiments described hereinabove by way of example; it extends to other alternative embodiments.

Thus, it is understood that the invention relates mainly to the profile of the penetration zone, and that the tool according to the invention can be without a decompression zone. In this alternative, its useful surface ends with a calibration zone.

The values referenced in FIG. 7B are provided here by way of example and naturally encompass variations depending on the forming desired.

Furthermore, in the examples shown hereinafter, the penetration zone begins with a plate PL. Alternatively, it can begin with teeth of relatively low height, for example, less than 10% of the height of the teeth in the calibration zone.

Although advantageous, the starting zone including the lead chamfer CH can be eliminated in simplified tool versions.

In the examples described hereinabove, the teeth have a substantially trapezoidal shape with straight sides. Alternatively, their sides can be curvilinear.

In the examples shown, the teeth have a profile capable of engraving grooves in the parts to be formed. Naturally, the present invention encompasses other alternatives with respect to the specific profile of the forming teeth.

The invention claimed is:

1. A cold forming tool having a forming reference axis and a plurality of regularly-spaced teeth with tips wherein the plurality of regularly-spaced teeth project away from an outer surface, the cold forming tool comprising:

at least one penetration zone defined by the forming reference axis and comprising some of the plurality of regularly-spaced teeth;

a calibration zone following the at least one penetration zone;

the calibration zone defined by the forming reference axis and comprising some of the plurality of regularly-spaced teeth;

the plurality of regularly-spaced teeth having a tooth height that increases substantially from the at least one penetration zone to the calibration zone;

a distance between the outer surface and the forming reference axis decreasing from the at least one penetration zone to the calibration zone; and a rate of increase in the tooth height between the at least one penetration zone and the calibration zone being greater than a rate of decrease in the distance between the outer surface and the forming reference axis between the at least one penetration zone and the calibration zone, whereby a distance between the tips and the forming reference axis increases substantially from a beginning of the at least one penetration zone to a beginning of the calibration zone, wherein the cold forming tool is adapted to form a part by rotating the part and ensuring that the part has substantially no axial displacement.

2. The tool of claim 1, further comprising a plate region having a width that is greater than a width of the plurality of regularly spaced teeth located at the beginning of the at least one penetration zone.

3. The tool of claim 2, wherein a distance between the outer surface and the forming reference axis is the same as a distance between an outer surface of the plate region and the forming reference axis.

4. The tool of claim 3, wherein the plate region is arranged adjacent a beginning of the at least one penetration zone.

5. The tool of claim 3, wherein the at least one penetration zone is arranged between the plate region and the calibration zone.

6. The tool of claim 2, wherein a mean distance between a mid-height of the plurality of teeth and the forming reference axis is substantially equal to a distance between an outer surface of the plate region and the forming reference axis.

7. The tool of claim 1, wherein, at least in the at least one penetration zone, a distance between a mid-height of each of the plurality of teeth and the forming reference axis is substantially constant.

8. The tool of claim 1, wherein the distance between the outer surface and the forming reference axis at a beginning of the at least one penetration zone comprises a maximum distance between the outer surface and the forming reference axis.

9. The tool of claim 1, wherein the distance between the outer surface and the forming reference axis is greater at the beginning of the at least one penetration zone than in other portions of the at least one penetration zone and than in the calibration zone.

10. The tool of claim 1, wherein the distance between the outer surface and the forming reference axis varies in a substantially continuous manner at least between a beginning of the at least one penetration zone and a beginning of the calibration zone.

11. The tool of claim 1, wherein the distance between the outer surface and the forming reference axis changes substantially continuously at least between a beginning of the at least one penetration zone and a beginning of the calibration zone.

12. The tool of claim 1, wherein the distance between the tips and the forming reference axis changes substantially continuously from a beginning of the at least one penetration zone to a beginning of the calibration zone.

13. The tool of claim 1, wherein the tooth height changes substantially continuously from a beginning of the at least one penetration zone to a beginning of the calibration zone.

14. The tool of claim 1, further comprising a starting zone defined by the forming reference axis.

15. The tool of claim 14, wherein the at least one penetration zone is arranged between the starting zone and the calibration zone.

16. The tool of claim 14, wherein the starting zone comprises an outer surface having an increasing distance with respect to the forming reference axis.

17. The tool of claim 14, wherein the starting zone comprises an outer surface whose distance from the forming reference axis increases between a beginning of the starting zone and an end of the starting zone arranged adjacent a beginning of the at least one penetrating zone.

18. The tool of claim 17, wherein, at the end of the starting zone, the distance between the outer surface of the starting zone and the forming reference axis is substantially equal to the distance between the outer surface and the forming reference axis in the beginning of the at least one penetrating zone.

19. The tool of claim 1, wherein the tooth height in the calibration zone is substantially constant.

20. The tool of claim 1, wherein the distance between the outer surface and the forming reference axis in the calibration zone is substantially constant.

21. The tool of claim 1, wherein each of the plurality of regularly-spaced teeth have a substantially trapezoidal shape in the at least one penetrating zone.

22. The tool of claim 21, wherein the trapezoidal shape comprises one of straight sides and curvilinear sides.

23. The tool of claim 1, further comprising a decompression zone defined by the forming reference axis and comprising some of the plurality of regularly-spaced teeth.

24. The tool of claim 23, wherein the calibration zone is arranged between the at least one penetrating zone and the decompression zone.

25. The tool of claim 24, wherein a distance between the tips and the forming reference axis decreases substantially from a beginning to an end of the decompression zone.

26. The tool of claim 1, wherein the cold forming tool comprises a substantially cylindrical part engaging surface.

27. The tool of claim 26, wherein the substantially cylindrical part engaging surface comprises a knurl surface.

28. The tool of claim 26, wherein the forming reference axis substantially coincides with an axis of rotation of the knurl surface.

29. A cold forming machine comprising at least one cold forming tool of claim 1.

30. A cold forming machine comprising:

two cold forming tools of claim 1, wherein axes of the two cold forming tools are arranged parallel to one another.

31. A method for cold forming a blank, the method comprising:

positioning the cold forming tool of claim 1 adjacent to the blank; and engaging the blank first with the beginning of the penetration zone and then with the calibration zone, wherein the blank moves during the engaging.

32. The method of claim 31, wherein the cold forming tool further comprises a plate region having a width that is greater than a width of the plurality of teeth arranged in the beginning of the penetration zone.

33. The method of claim 32, wherein the engaging comprises engaging the blank first with the plate region, then with the beginning of the penetration zone, and then with the calibration zone.

34. The method of claim 31, wherein the cold forming tool further comprises a starting zone that precedes the penetration zone.

35. The method of claim 34, wherein the starting zone comprises an outer surface whose distance from the forming reference axis increases between a beginning of the starting zone and an end of the starting zone arranged adjacent the beginning of the penetrating zone, and wherein the engaging comprises engaging the blank first with the starting zone, then with the penetration zone, and then with the calibration zone.

36. The method of claim 31, wherein the positioning comprises positioning two forming tools adjacent to the blank, each of the two forming tools comprising the penetration zone followed by the calibration zone and wherein the engaging comprises engaging the blank with the two tools first with the beginning of the penetration zones and then with the calibration zones.

37. The method of claim 31, wherein the two forming tools are homologous.

38. A cold forming tool having a substantially planar part engaging surface and a plurality of regularly-spaced teeth with tips wherein the plurality of regularly-spaced teeth project away from an outer surface, the cold forming tool comprising:

at least one penetration zone comprising some of the plurality of regularly-spaced teeth;

a calibration zone arranged adjacent the at least one penetration zone;

the calibration zone comprising some of the plurality of regularly-spaced teeth;

the plurality of regularly-spaced teeth having a tooth height that increases substantially from the at least one penetration zone to the calibration zone;

a distance between the outer surface and a reference plane decreasing from the at least one penetration zone to the calibration zone; and a rate of increase in the tooth height between the at least one penetration zone and the calibration zone being greater than a rate of decrease in the distance between the outer surface and the reference plane between the at least one penetration zone and the calibration zone, whereby a distance between the tips and the reference plane increases substantially from a beginning of the at least one penetration zone to a beginning of the calibration zone, wherein the cold forming tool is adapted to form a part by rotating the part and ensuring that the part has substantially no axial displacement.

39. The tool of claim 38, wherein the cold forming tool comprises a cold forming rack.

40. A cold forming machine comprising at least one cold forming tool of claim 38.

41. A cold forming machine comprising:

two cold forming tools of claim 38, wherein the substantially planar part engaging surfaces of the two cold forming tools are arranged parallel to one another.

42. A cold forming machine comprising:

a first cold forming tool comprising a first part engaging surface and a plurality of regularly-spaced teeth with tips wherein the plurality of regularly-spaced teeth project away from a first surface;

the first cold forming tool comprising at least one penetration zone comprising some of the plurality of regularly-spaced teeth, a calibration zone arranged adjacent the at least one penetration zone, the calibration zone comprising some of the plurality of regularly-spaced teeth, the plurality of regularly-spaced teeth having a tooth height that increases substantially from the at least one penetration zone to the calibration zone, a distance between the first surface and a first reference location decreasing from the at least one penetration zone to the calibration zone, and a rate of increase in the tooth height between the at least one penetration zone and the calibration zone being greater than a rate of decrease in the distance between the first surface and the first reference location between the at least one penetration zone and the calibration zone, whereby a distance between the tips and the first reference location increases substantially from a beginning of the at least one penetration zone to a beginning of the calibration zone;

a second cold forming tool having a second part engaging surface and a plurality of regularly-spaced teeth with tips wherein the plurality of regularly-spaced teeth project away from a second surface;

the second cold forming tool comprising at least one penetration zone comprising some of the plurality of regularly-spaced teeth, a calibration zone arranged adjacent the at least one penetration zone, the calibration zone comprising some of the plurality of regularly-spaced teeth, the plurality of regularly-spaced teeth having a tooth height that increases substantially from the at least one penetration zone to the calibration zone, a distance between the second surface and a second reference location decreasing from the at least one penetration zone to the calibration zone, and a rate of increase in the tooth height between the at least one penetration zone and the calibration zone being greater than a rate of decrease in the distance between the second surface and the second reference location between the at least one penetration zone and the calibration zone, whereby a distance between the tips and the second reference location increases substantially from a beginning of the at least one penetration zone to a beginning of the calibration zone; and an arrangement for moving the first and second cold forming tools, wherein the cold forming machine is adapted to form a part by rotating the part and ensuring that the part has substantially no axial displacement.

43. The machine of claim 42, wherein the first and second part engaging surfaces are arranged opposite one another.

44. The machine of claim 42, wherein the first reference location comprises a first rotation axis of the first cold forming tool and the second reference location comprises a second rotation axis of the second cold forming tool.

45. The machine of claim 42, wherein the first reference location comprises a first reference plane and the second reference location comprises a second reference plane.

46. The machine of claim 42, wherein the first and second part engaging surfaces comprises substantially cylindrical part engaging surfaces.

47. The machine of claim 42, wherein the first and second part engaging surfaces comprises substantially planar part engaging surfaces.

48. The machine of claim 42, wherein the arrangement for moving the first and second cold forming tools moves the first and second tools relative to one another and in opposite directions.

49. The machine of claim 42, wherein the arrangement for moving the first and second cold forming tools moves the first and second tools parallel to one another and in opposite directions.

50. The machine of claim 42, wherein the arrangement for moving the first and second cold forming tools causes the first and second tools to rotate.

51. The machine of claim 42, wherein the arrangement for moving the first and second cold forming tools rotates the first and second tools in opposite directions.

52. The machine of claim 42, wherein the arrangement for moving the first and second cold forming tools moves, at the same time, the first and second tools into engagement with the part.

53. The machine of claim 42, further comprising an arrangement for moving the first and second cold forming tools away from one another, whereby the arrangement for moving the first and second cold forming tools away from one another is adapted to be activated at least after a blank calibration stage is performed.

54. The machine of claim 42, wherein each of the first and second cold forming tools comprise a decompression zone.

55. The machine of claim 54, wherein a distance between the tips and the first reference location decreases substantially from a beginning to an end of the decompression zone of the first cold forming tool, and wherein a distance between the tips and the second reference location decreases substantially from a beginning to an end of the decompression zone of the second cold forming tool.

56. A cold forming tool having a plurality of teeth with tips wherein the plurality of teeth project away from an outer surface, the cold forming tool comprising:

a penetration zone comprising some of the plurality of teeth;

a calibration zone arranged adjacent the penetration zone and comprising some of the plurality of teeth;

each adjacent tooth of the penetrating zone increasing in height from a beginning of the penetration zone to a beginning of the calibration zone;

a distance between the outer surface and a reference point decreasing from a beginning of the penetration zone to at least a beginning of the calibration zone; and a rate of increase in the tooth height between the penetration zone and the calibration zone being greater than a rate of decrease in the distance between the outer surface and the reference point between the penetration zone and the calibration zone, whereby a distance between the tips and the reference point substantially increases from a beginning of the at least one penetration zone to a beginning of the calibration zone, wherein the cold forming tool is adapted to form a part by rotating the part and ensuring that the part has substantially no axial displacement.

* * * * *

UNITED STATES PATENT AND TRADEMARK OFFICE

CERTIFICATE OF CORRECTION

PATENT NO. : 7,040,131 B2
APPLICATION NO. : 10/485251
DATED : May 9, 2006
INVENTOR(S) : P. Monot It is certified that error appears in the above-identified patent and that said Letters Patent is hereby corrected as shown below:

On the title of the printed patent, at Item (73), Assignee, "Technologies" should be --Technologie--.

On the title of the printed patent, at Item (73), Assignee, "Chalone" should be --Chalon--.

Signed and Sealed this

Twenty-fourth Day of October, 2006

JON W. DUDAS
*Director of the United States Patent and Trademark Office*